US005513482A

United States Patent [19]

Nagashima et al.

[11] Patent Number: 5,513,482

[45] Date of Patent: May 7, 1996

[54] STRAPPING MACHINE

[75] Inventors: Akira Nagashima, Yokohama; Tadashige Kondo; Keisuke Ishii, both of Tokyo, all of Japan

[73] Assignee: Kioritz Corporation, Tokyo, Japan

[21] Appl. No.: 276,400

[22] Filed: Jul. 18, 1994

[30] Foreign Application Priority Data

Jul. 20, 1993 [JP] Japan ..... 5-179262

[51] Int. Cl.[6] ..... B65B 11/00

[52] U.S. Cl. ..... 53/582; 53/375.9; 53/589; 100/26

[58] Field of Search ..... 53/389.2, 389.3, 53/582, 589, 375.9; 100/26, 29, 32, 33

[56] References Cited

U.S. PATENT DOCUMENTS

| | | | |
|---|---|---|---|
| 3,841,055 | 10/1974 | Takani | 53/389.3 |
| 4,488,926 | 12/1984 | Rauch et al. | 53/582 |
| 4,850,179 | 7/1989 | Takani et al. | 53/582 |
| 5,079,899 | 1/1992 | Kurachi . | |

FOREIGN PATENT DOCUMENTS

| | | |
|---|---|---|
| 2906425 | 9/1979 | Germany . |
| 3444391C2 | 6/1985 | Germany . |
| 3610631 | 10/1987 | Germany . |

OTHER PUBLICATIONS

Office Action from the German Patent Office dated Sep. 21, 1995; Reference No. 10645P DE/bs; citing the above-listed German Patent.

*Primary Examiner*—John Sipos
*Assistant Examiner*—Ed Tolan
*Attorney, Agent, or Firm*—Armstrong, Westerman, Hattori, McLeland & Naughton

[57] ABSTRACT

A strapping machine is disclosed which enables the operation cams such as the press cam, the heater cam, the slide cam and the like as well as the cam driving motor to be miniaturized, and which is capable of diminishing damages on the operation cams to realize prolonged lives of the cams and hence optimally eliminating cumbersome maintenance operations such as replacement of the cams, and yet whose structure can be rendered simple and inexpensive as a whole, and which enables energy saving to be realized. The strapping machine comprises a band feeding/tightening means F for feeding/tightening a band B to be looped around a periphery of an object to be strapped and the like operation; a band leading end treating means K including a mechanism for conducting a procedure which includes holding, pressing, fusing, cutting the band B and the like operation by actions of a plurality of cams 21, 22, 23, 24, 25 and 26; and a cam driving stepping motor M2 for driving said cams 21, 22, 23, 24, 25 and 26.

5 Claims, 7 Drawing Sheets

STRAPPING MACHINE

BACKGROUND OF THE INVENTION

1. Field of the Invention

The present invention relates to a strapping machine, in particular, it relates to a strapping machine adapted to be capable of automatically or semi-automatically conducting a procedure which includes looping a band made of a tape of a thermoplastic resin such as a polypropylene around an object to be strapped, and fusion-bonding an overlapping portion of the band to effect strapping.

2. Description of the Prior Art

To realize heightened efficiency and energy savings in a strapping operation, a strapping machine has already been practically used in general which is adapted to be capable of conducting a procedure that includes looping a band made of a thermoplastic resin tape around an object to be strapped, tightening the band, fusion-bonding the resulting nodally overlapping end portion of the band under heat and pressure, and cutting the band.

In such a conventional strapping machine, a two-stage tightening is generally conducted as an operation for tightening a band, which comprises a primary tightening for high-speed/low-torque tightening of a band and a secondary tightening under low-speed/high-torque operation (see, for example, Japanese Examined Patent Publication No.13205/1992).

Of the conventional strapping machines, a strapping machine has been known which is provided with an electric motor such as an induction motor for driving cams such as a press, a heater, a slide and the like for strapping with a band to cause timely shifted rotations thereof, and an electromagnetic clutch interposed between the electric motor and each of the cams, thereby intermittently controlling the driving force of the electric motor by means of the electromagnetic clutch (see, for example, Japanese Examined Patent Publication No.69774/1991, and Japanese Unexamined Patent Publication No.58613/1989).

In such a conventional strapping machine, when the electric motor such as an induction motor is stopped by being locked via the electromagnetic clutch, an excessive temperature elevation is likely to occur due to a constant electrical current continuously applied to the electric motor, and a power circuit is required for driving the electromagnetic clutch, thereby leading to a complicated structure. Further, there is a problem that since each of the operation cams such as a press, a heater, a slide and the like has a cam profile with portions having an abruptly changing curvature, extra idle portions or the like, the cams undergo considerable impact due to the abruptly changed load and hence they are likely to undergo severe abrasion, leading to brief spans of lives of the cams, and, consequently, it is inevitably required to frequently carry out cumbersome maintenance operations such as the replacement of a cam. Moreover, there is a problem that since a large force is required for driving the cams, a large-sized cam driving motor is unavoidably used.

SUMMARY OF THE INVENTION

The present invention has been made in view of these problems. It is, therefore, an object of the present invention to provide a strapping machine which enables the operation cams such as the press cam, the heater cam, the slide cam and the like as well as the cam driving motor to be miniaturized, and which is capable of diminishing damages on the operation cams to realize prolonged lives of the cams and, hence, capable of optimally eliminating cumbersome maintenance operations such as replacement of the cams, and yet whose structure can be rendered simple and inexpensive as a whole, and which enables energy saving to be realized.

To attain the above-mentioned object, the strapping machine according to the present invention comprises:

a band feeding/tightening means for feeding/tightening a band to be looped around a periphery of an object to be strapped and the like operation;

a band leading end treating means including a mechanism for conducting a procedure which includes holding, pressing, fusing, cutting the band and the like operation by actions of a plurality of cams; and a cam driving motor for driving said cams;

wherein said cam driving motor is a stepping motor capable of being kept in a stopped state at least during the fusion-bonding of said band.

In the strapping machine according to the present invention which is constructed as described above, a band is fed by the operation of the band feeding/tightening means, and the band is looped around a periphery of an object to be strapped, and then, by the actions of the plurality of the cams, the procedure is conducted which includes holding, pressing, and fusing the resulting overlapping portion of the band, followed by cutting the band and the like operation. The cam driving stepping motor is kept in a stopped state at least during the fusion-bonding of the band.

DESCRIPTION OF THE PREFERRED EMBODIMENT

Now, an embodiment of the present invention will be described with reference to the accompanying drawings.

Figure 1:
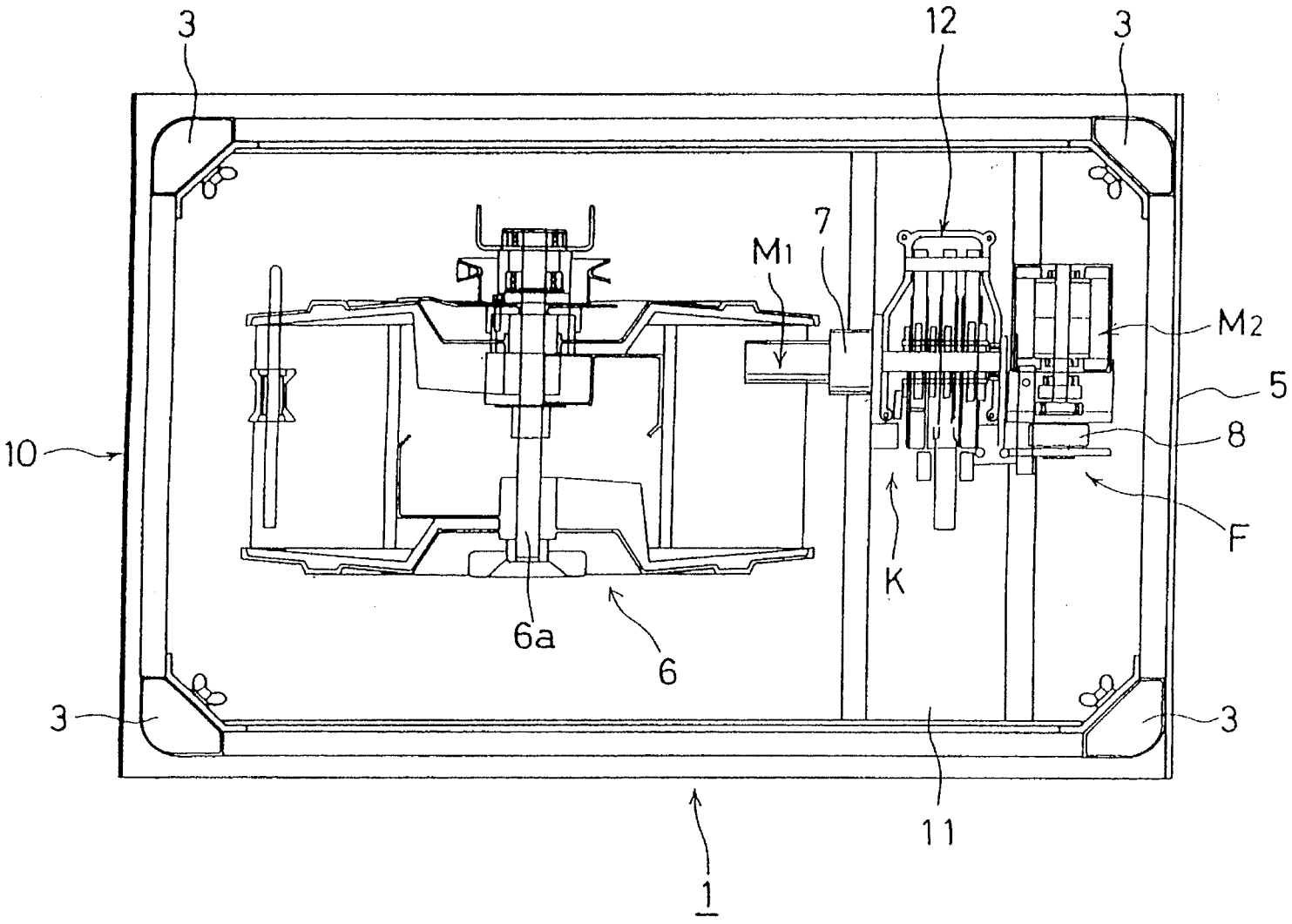
FIG.1 is a schematic plan view of one embodiment of the strapping machine according to the present invention, which is illustrated with its top plate removed by way of generally showing interior thereof.
Figure 2:
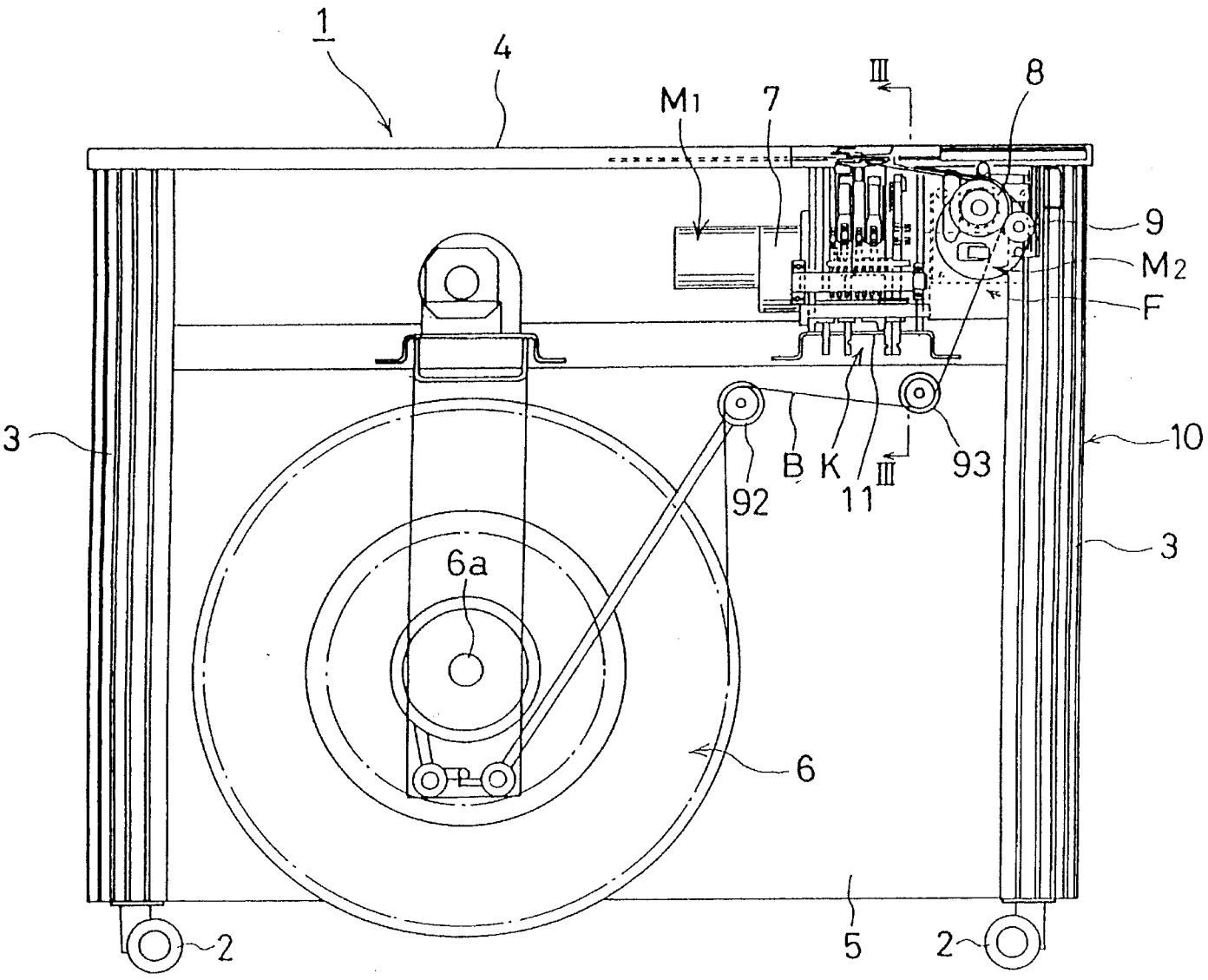
FIG.2 is a schematic front view of the strapping machine shown in FIG.1.
Figure 3:
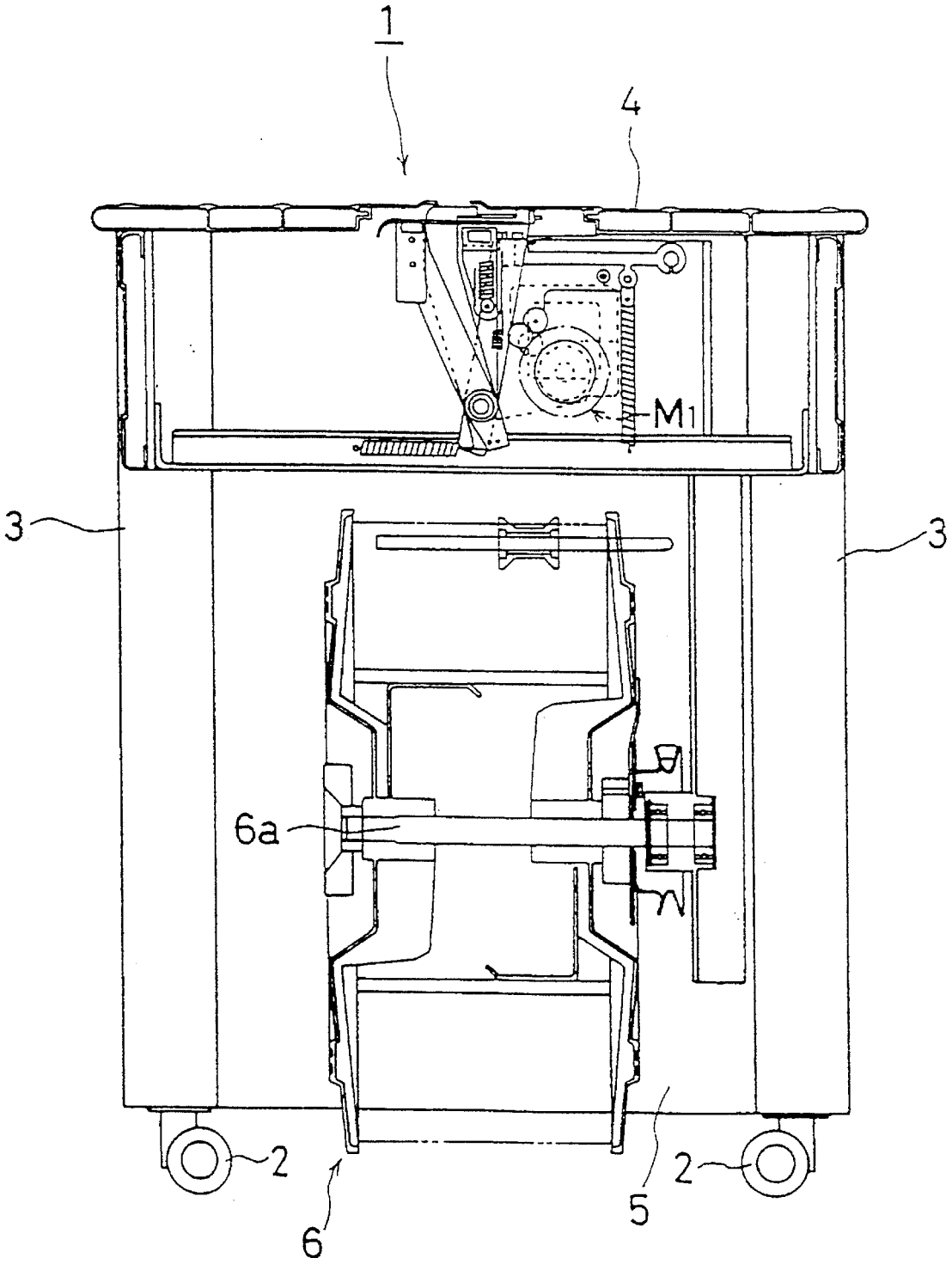
FIG.3 is a schematic sectional side view taken along the line III—III and viewed in the direction of the arrow in FIG.2.

FIG.1 is a schematic plan view of one embodiment of the strapping machine according to the present invention, which is illustrated with its top plate removed by way of generally showing interior thereof. FIG.2 is a schematic front view of the same. FIG.3 is a schematic sectional side view of the same taken along the line III—III and viewed in the direction of the arrow in FIG.2.

In FIGS. 1 to 3, the strapping machine 1 according to the illustrated embodiment comprises a box-like strapping machine body 10 as a frame member which includes posts 3, 3, . . . having their lower ends provided with casters 2, 2, . . . , a top plate 4 horizontally mounted on and spanning the upper ends of the posts 3, 3, . . . , a side plate 5 surrounding four sides of the frame member, monitoring windows (not shown) openably formed at appropriate positions in the side plate 5 and the like. On the top of the strapping machine body 10, a band guiding arch (not shown) which is tubular and formed into a staple-like shape for automatically putting a band B around an object to be strapped may further be mounted, if desired. The posts 3, 3 . . . , and the top plate 4 are, for example, integrally formed by extrusion molding of aluminum.

In the strapping machine body 10, a band reel 6 is disposed with its shaft 6*a* transversely set which is capable of being loaded with a band coil. In the strapping machine body 10, in a portion opposite to the portion where the band reel 6 is located (right portion in FIGS.1 and 2) and at an upper level is (beam-wise) fixedly mounted a supporting plate 11 which extends horizontally and transversely, and on the upper surface of the supporting plate 11 is fixedly mounted a frame 12 having a horizontal cross-section of a staple-like shape. Between right and left side plates 12*b* and 12*a* of the frame 12 is disposed a means K for feeding a band and nodal end treatment (detailed description is given hereinbelow) which includes various cams and arms for holding, pressing, fusing, and cutting of the band B. On the outer surface of the left side plate 12*a* of the frame 12 is mounted a cam driving stepping motor M1 provided with a speed reducer 7 for driving the means K for band feeding and nodal end treatment in alignment with the means K. Outside the right side plate 12*b* is fixed in juxtaposition therewith a band feeding/tightening (hereinafter also referred to as "feed/backfeed") means F including a reversely rotatable feed/backfeed stepping motor M2, a feed/backfeed roller 8, a rocker roller 9 and the like.

Then, the strapping machine 1 according to the illustrated embodiment will be described in detail.

Figure 4:
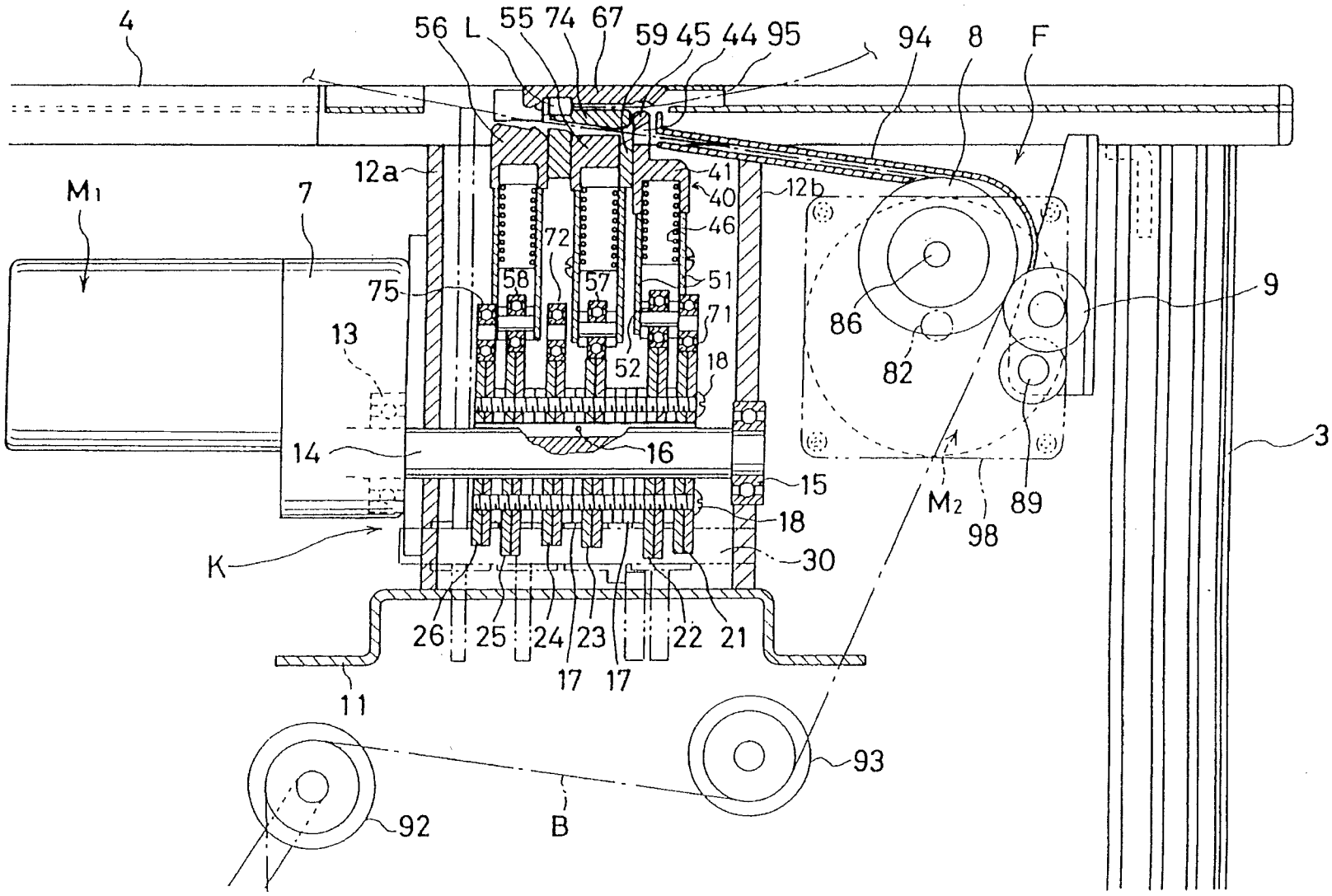
FIG.4 is an enlarged view of the operative portion in FIG.2.
Figure 5:
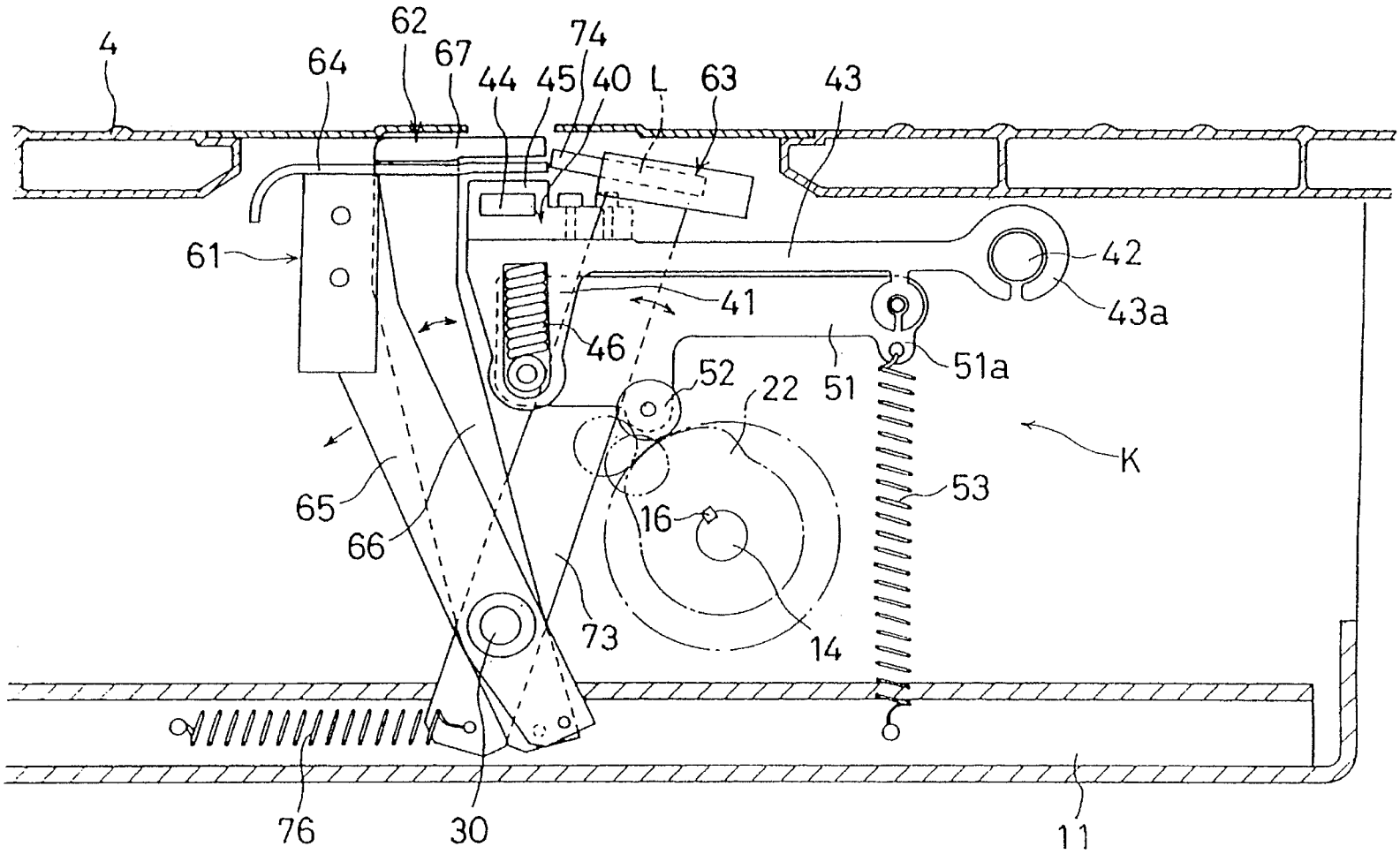
FIG.5 is an enlarged view of the operative portion in FIG.3.

FIG.4 is an enlarged view of the operative portion in FIG.2, and FIG.5 is an enlarged view of the operative portion in FIG.3.

First, explanation is given with respect to the means K for band feeding and nodal end treatment.

A driving force from the cam driving stepping motor M1 is decelerated by means of the speed reducer 7 and transmitted to a cam shaft 14 journaled on a rolling bearing 13. The cam shaft 14 is transversely mounted between the side plates 12*a* and 12*b* of the frame 12, and on the part of the right side plate 12*b*, it is journaled on a rolling bearing 15.

As shown in FIG.4, a heater cam 21, a front clamp cam 22, a press cam 23, a slide cam 24, a rear cam 25, and an inner slide cam 26 are fit on the cam shaft 14, and locked by a key 16. Each of the cams 21–26 is formed by laminating two planar pieces duplicate each other which have been punched out in a predetermined shape by means of a punching press. To form an appropriate spacing between each neighboring cams, planar spacers 17, 17, . . . , which are of the same circular shape and made of a plastic or the like, are interposed between the cams, and the spacers 17, 17, . . . and the cams 21–26 are securely screwed together by means of bolts 18, 18.

Between the right and left side plates 12*b* and 12*a*, a front clamp 40 is disposed which vertically moves in response to rotation of the clamp cam 22. The front clamp 40 comprises a spring inserting portion 41 having a gate-shaped cross-section, an elongate flat arm 43 formed integrally with the spring inserting portion 41 and having its root end formed with a partially cut away ring portion 43*a* pivotally mounted on a pivot 42, and a head 45 fixed onto the spring inserting portion 41 by bolts or the like. The front clamp 40 is formed by extrusion molding of material such as aluminum, and a guide aperture 44 for guiding a band during feeding is formed in the head 45 by perforation.

To the inner surfaces of right and left legs (when viewed in section as shown in FIG. 4) of the spring inserting portion 41, cam roller supporting members 51, 51 made of a steel are attached which extend transversely (in the right direction in FIG.5) from the spring inserting portion 41 in parallel with the arm 43. In an upper portion of the space defined by the cam roller supporting members 51, 51, a spring member 46 which exhibits a buffer action is inserted. In a lower portion thereof, a cam roller 52 which swings in response to the motion of the clamp cam 22 is held between the cam roller supporting members 51, 51. The cam roller supporting member 51 is pivotally mounted on the arm 43 of the front clamp at its root end 51*a*, and a spring member 53 is interposed between the root end 51*a* and the supporting plate 11 for biasing to cause the cam roller 52 to be pressed against the clamp cam 22.

Likewise, the press 55 and the rear clamp 56 (shown in FIG. 4) have substantially the same structures as that of the front clamp 40 (detailed explanation on the structures is accordingly omitted), and are provided with cam rollers 57, 58 which swing in response to the motions of the press cam 23 and the clamp cam 25, respectively. In this connection, a cutter member 59 for cutting a band is unitedly fixed onto an upper side edge of the press 55.

As shown in FIG.5, a heater member 61, a slide member 62 and a middle slide member 63 are swingably arranged in the vicinity of the upper end of the space between the side plates 12*a* and 12*b*. The heater member 61 comprises a heater plate 64 located on its upper end, and a heater arm 65 fixed to the lower surface of the heater plate 64 and extending downward. The heater arm 65 is swingably journaled on a pivot 30 transversely mounted between the side plate 12*a* and 12*b*. The heater arm 65 is adapted to be swingable in association with the heater cam 21 via a cam roller 71.

Likewise, the slide member 62 comprises a slide arm 66 journaled on the pivot 30, and a slide table 67 fixed to the upper surface of the slide arm 66. The slide arm 66 is adapted to be swingable in association with the slide cam 24 via a cam roller 72.

Further, on the pivot 30, the middle slide member 63 is disposed opposite to the heater member 61 and the slide member 62. In other words, the slide member 63 comprises a middle slide arm 73 journaled on the pivot 30, and a middle slide 74 which is fixed to the upper end of the middle slide arm 73 and to which a limit switch L is fixedly attached. The middle slide arm 73 is adapted to be swingable in association with the slide cam 26 via a cam roller 75. In this connection, between the lower ends of the arms 65,66 and 73 of the heater member 61, slide member 62 and middle slide member 63 and the supporting plate 11, spring members 76, 76 and 76 for biasing are interposed to cause the cam rollers 71,72 and 75 to be pressed against the heater cam 21, slide cam 24, and middle slide cam 26, respectively.

Next, the band feeding/tightening means F is described.

Figure 6:
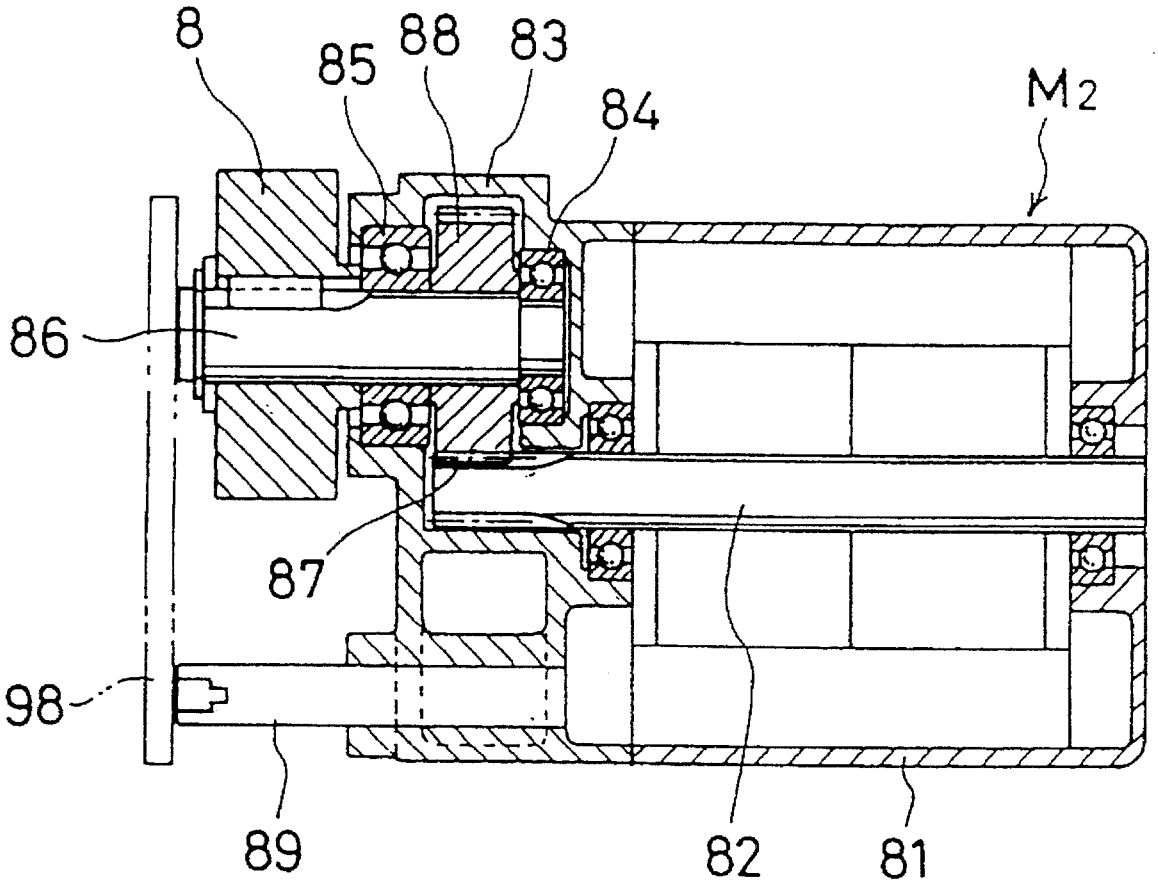
FIG.6 is a vertical cross-sectional view of the feed/backfeed stepping motor M2 used in the embodiment of the strapping machine according to the present invention.
Figure 7A:
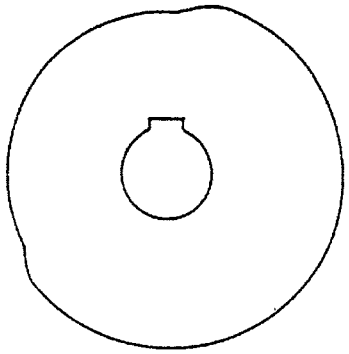
FIG.7 illustrates cam profiles each showing one example of shapes of cams used in the embodiment according to the present invention.
Figure 7B:
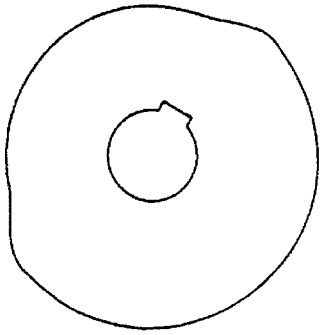
Figure 7C:
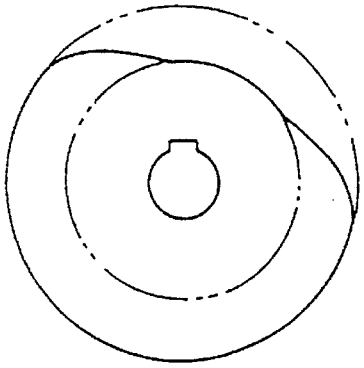
Figure 7D:
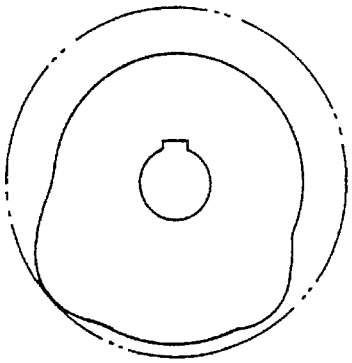
Figure 7E:
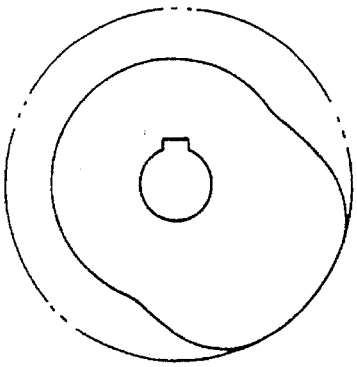
Figure 7F:
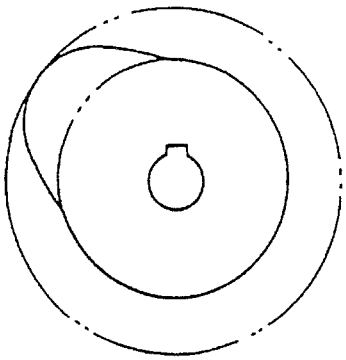

FIG.6 is a vertical cross-sectional view of the feed/backfeed stepping motor M2. The stepping motor M2 according to the illustrated embodiment comprises a motor body 81, and a gear case 83 unitarily fixed to the motor body 81 on the side from which an output shaft 82 protrudes. In the gear case 83, a feed/backfeed roller shaft 86 is journaled via bearings 84, 85 to protrude forward (toward the left in FIG.6). A feed/backfeed roller reversibly rotating gear 88 which mates with teeth 87 formed in the tip portion of the output shaft 82 is fixedly mounted on the feed/backfeed roller shaft 86 in the vicinity of the end thereof in the gear case 83. On the other hand, the feed/backfeed roller 8 is fixedly mounted on the distal end portion of the feed/backfeed roller shaft 86. In the vicinity of the periphery of the gear case 83, a mounting rod 89 for fixing a band guide cover 98 in front of the feed/backfeed roller 8 is so fitted into the gear case 83 as to protrude forward. The rocker roller 9 is mounted in such a manner that it is normally caused to be pressed against the feed/backfeed roller 8 by means of a biasing means (not shown) (see FIG.4).

As is seen from FIG.4, the band B wound on the band reel 6 is led sequentially via a twist roller 92, an idle roller 93 and through the abutting portion between the feed/backfeed roller 8 and the rocker roller 9, a tubular band guide member 94, the guide aperture 44 of the front clamp 40, a gap between the press 55 and the middle slide 74, a gap between the rear clamp 56 and the slide table 67 and the like, and caused to emerge out of the top plate 4. Then, the band B is led making a loop around an object to be strapped (when a band arch is placed, the loop is formed in the course of passing the band B through the inner path of the band arch), and the leading end of the band B is reintroduced into the strapping machine 1 from a band introducing aperture 95 formed beside the slide table 67 and passed through a gap between the slide table 67 and the middle slide 74 and caused to touch the limit switch L, thereby completing setting.

Next, operation of the strapping machine having such a structure according to one embodiment of the present invention will be described.

When a starting switch of a controlling device (not shown) is controlled to actuate the stepping motor M2 for feeding/backfeeding, the feed/backfeed roller 8 starts in rotation to feed the band B. The band B is looped around an object to be strapped with a clearance therebetween, as described above, and caused to touch the limit switch L to stop the feed/backfeed stepping motor M2, thereby completing setting of the band B.

Then, the cam driving stepping motor M1 is actuated to rotate the clamp cam 22, and by the motion of the cam roller 52 which is a follower of the clamp cam 22, the arm 43 is swung upward about the pivot 42 to boost the clamp 40, so that the leading end of the band B thus fed is clamped between the upper end surface of the clamp 40 and the lower surface of the slide table 67. Thereupon, the cam driving stepping motor M1 stops while the feed/backfeed stepping motor M2 starts in rotation in the direction of tightening (backfeed) reverse to the direction of feeding (feed) to carry out primary tightening under high-speed/low-torque operation. When the band B is caused to abut upon the peripheral surface of the object under strapping to such an extent that a predetermined tension is exerted on the band B, operation mode of the feed/backfeed stepping motor M2 is automatically switched over to low-speed/high-torque rotation by means of a tension sensor to conduct secondary tightening. Throughout the durations of the primary and secondary tightening, the operation of the cam driving stepping motor M1 is maintained in a stopped state.

Subsequently, when the tension exerted upon the band B by the secondary tightening reaches an upper limit set in the tension sensor, the cam driving stepping motor M1 is actuated again, thereby bringing the rear clamp cam 25 into operation to boost the rear clamp 56. Consequently, the rear of the overlapping nodal portion is clamped between the upper surface of the rear clamp 56 and the lower surface of the slide table 67.

Then, the heater arm 65 and the middle slide arm 73, which respectively support the heater plate 64 and the middle slide 74 that are located oppositely each other in the width direction of the band B, swing to-and-fro in association with each other about the pivot 30 via the cam rollers 71 and 75 which are respectively caused to operate in response to the rotational motions of the heater cam 21 and the middle slide cam 26. In other words, when the middle slide 74 is caused to slide in the direction retreating from the position adjoining to the nodally overlapping portion of the band B (the right direction in FIG.5), concurrently therewith, the heater plate 64 is also caused to slide (being preceded by the middle slide 74) in the same direction (the right direction in FIG.5). In this manner, the heater plate 64 is inserted into the gap in the overlapping portion of the band B, in which the overlapping portions of the band B are vertically spaced from each other under tension, in place of the middle slide 74. Thereupon, the press 55 is boosted by the operation of the press cam 23 and the cam roller 57 to sandwich-wise press the band B in the overlapping portion on the heater plate 64, thereby simultaneously effecting fusion of the facing surfaces of the band B. In this connection, the press 55 is first pressed lightly against the overlapping portion of the band B, and then once caused to descend. Thereupon, the heater plate 64 is caused to retreat from the overlapping portion of the band B (toward the left side in FIG.5), and then the press 55 is boosted again to cut the band B with the cutter member 59 at a position proximate to the front clamp 40. The press 55 is now strongly pressed against the overlapping portion of the band B, and in this condition, the overlapped portion of the band B is cooled for a predetermined period of time (for example, 1 to 1.7 sec.). Thereafter, the press 55 is caused to descend. Incidentally, during the first pressing operation and the cooling, the cam driving stepping motor M1 is kept in a stopped state with the press 55 kept at the boosted position.

Finally, the slide table 67, which has been kept at substantially the same level as the upper surface of the top plate 4 throughout the above-mentioned procedure, is caused to swing about the pivot 30 in the retreatal direction (the left direction in FIG.5) via the cam roller 72 which is a follower of the slide cam 24, the slide arm 66 and the like.

As described above, by virtue of the use of the stepping motor as a cam driving motor, whose output shaft can freely be controlled between rotation and a stopped state in response to pulse signals from the controlling device, the strapping machine according to the present invention enables driving of each of the cams 21–26 to be kept stopped at a predetermined timing. Accordingly, it is not necessary to provide cams with a portion having an abruptly changing curvature, an extra idle portion for mode maintenance, or the like. Hence the cams 21–26 can be formed into cam profiles of smoother shapes (shapes having a larger perimetric proportion of arc portions with constant radius). FIG.7 illustrates cam profiles each showing one example of shapes of the cams 21–26. In FIG.7, the examples of shapes of the front clamp cam, the rear clamp cam, the middle slide cam, the press cam, the heater cam, and the slide cam are shown as cam profiles (a) to (f), respectively. As is apparent from FIG.7, each of the cam profiles is smooth. Accordingly, prolonged life of each of the cams can be attained, and reduction of the force required for driving the cams can be attained and hence enables the cam driving stepping motor M1 to be miniaturized, and yet the cams per se can be miniaturized. Thus, energy saving and cost reduction can be realized.

Hereinbefore, one embodiment of the present invention has been described in detail. It is, however, to be understood that the present invention is by no means restricted to the above-described embodiment and that various changes and modifications may be made without departing form the scope of the invention defined in the appended claim.

For example, although the stepping motor M2 is used also as the feed/backfeed motor for effecting feeding/tightening of a band in the illustrated embodiment, another type of motor such as an induction motor may of course be used.

As understood from the above description, according to the present invention, it is possible to miniaturize not only the cam driving motor but also the operation cams such as the press cam, the heater cam, the slide cam and the like, and yet damages on the operation cams can be diminished to realize prolonged lives thereof and hence to optimally eliminate cumbersome maintenance operations such as replacement of the cams. Further, the structure can be rendered simple and inexpensive as a whole, and energy saving can be realized.

What is claimed is:

1. A strapping machine, comprising:

a band feeding/tightening means (F) for feeding/tightening a band (B) to be looped around a periphery of an object to be strapped;

a band leading end treating means (K) including a mechanism for conducting a procedure which includes holding, pressing, fusing, and cutting the band (B) by actions of a plurality of cams (121, 22,23, 24, 25 and 26); and a cam driving motor (M1) for driving said cams (21, 22, 23, 24, 25 and 26);

said cam driving motor (M1) is a stepping motor capable of being kept in a stopped state at least during the fusion-bonding of band (B); and control means for keeping the motor in a stopped state at least during the fusion bonding of said band (B).

2. A method of strapping a band around an object, comprising the steps of:

(a) providing a strapping machine, comprising:

a band feeding/tightening means (F) for feeding/tightening a band (B) to be looped around a periphery of an object to be strapped;

a band leading end treating means (K) including a mechanism for conducting a procedure which includes holding, pressing, fusing, and cutting the band (B) by actions of a plurality of cams (21, 22,23, 24, 25 and 26); and a cam driving motor (M1) for driving said cams (21, 22, 23, 24, 25 and 26);

said cam driving motor (M1) is a stepping motor capable of being kept in a stopped state at least during the fusion-bonding of band (B); and control means for keeping the motor in a stopped state at least during the fusion bonding of said band (B);

(b) feeding and locating a band so as to loop around the periphery of an object with the band feeding/tightening means (F) and the band leading end treating means (K);

(c) fusing the band with the band leading end treating means (K) with said motor (M1) maintained in a stopped state, during at least part of a time of said fusing, such that none of said cams are moved.

3. The Method of claim 2, wherein: said step (c) includes actuating the motor (M1) to rotate a heater cam which moves a heater plate to heat an overlapping portion of the band (B) and to rotate a press cam (23) which moves a press (55) which presses the overlapping portion of the band, thereby fusing the overlapping portion of the band, wherein during at least part of the time which said press (55) presses said band, the motor (M1) is maintained in a stopped state.

4. The Method of claim 3, wherein: said step (b) includes setting the band to a looped state around the object; actuating the motor (M1) to rotate a clamp cam so as to clamp a leading end of the band, then stopping the motor (M1); tightening the band with the motor (M1) still stopped; when the band is at a predetermined tension, actuating the motor (M1) to rotate a rear clamp to clamp a rear of an overlapping nodal portion of the band.

5. The Method of claim 2, wherein: said step (b) includes setting the band to a looped state around the object; actuating the motor (M1) to rotate a clamp cam so as to clamp a leading end of the band, then stopping the motor (M1); tightening the band with the motor (M1) still stopped; when the band is at a predetermined tension, actuating the motor (M1) to rotate a rear clamp to clamp a rear of an overlapping nodal portion of the band.

* * * * *